US005922226A

United States Patent [19]

Mizusawa

[11] Patent Number: 5,922,226

[45] Date of Patent: Jul. 13, 1999

[54] METHOD AND APPARATUS FOR CONTROLLING ENERGIZING OF HEATER IN AIR-FUEL RATIO SENSOR

[75] Inventor: Kazuya Mizusawa, Toyota, Japan

[73] Assignee: Toyota Jidosha Kabushiki Kaisha, Toyota, Japan

[21] Appl. No.: 08/880,401

[22] Filed: Jun. 23, 1997

[30] Foreign Application Priority Data

Jun. 26, 1996 [JP] Japan ..... 8-165528

[51] Int. Cl.[6] ..... H05B 1/02

[52] U.S. Cl. ..... 219/207; 219/492; 219/202; 219/508; 219/486; 219/485; 123/179.16

[58] Field of Search ..... 219/483–486, 219/501, 202–208, 497, 492, 508, 509; 123/179.16, 179.6; 307/117, 38–41

[56] References Cited

U.S. PATENT DOCUMENTS

| | | | |
|---|---|---|---|
| 4,282,422 | 8/1981 | Payne et al. | 219/486 |
| 4,504,732 | 3/1985 | Bube et al. | 219/497 |
| 5,012,070 | 4/1991 | Reed | 219/202 |
| 5,523,547 | 6/1996 | Miller | 219/202 |
| 5,528,016 | 6/1996 | Mogi | 219/486 |

FOREIGN PATENT DOCUMENTS

A 63-176641 7/1988 Japan .

*Primary Examiner*—Mark Paschall
*Attorney, Agent, or Firm*—Oliff & Berridge, PLC

[57] ABSTRACT

An apparatus and method for controlling the energization of a plurality of sensors used for detecting the air-fuel ratio in an internal combustion engine. The engine has an exhaust passage, and the air-fuel ratio sensors are provided in the exhaust passage. Each sensor includes an element for outputting a signal corresponding an oxygen concentration of the exhaust gas from the engine and a heater for heating the element. The element is activated at a predetermined temperature. A Central Processing Unit (CPU) controls the energizing the heaters. The CPU starts energizing each heater at different time. Alternatively, the CPU inputs duty signals having different phases to the heaters. As a result, the total current load from the heaters is lowered.

18 Claims, 8 Drawing Sheets

METHOD AND APPARATUS FOR CONTROLLING ENERGIZING OF HEATER IN AIR-FUEL RATIO SENSOR

BACKGROUND OF THE INVENTION

1. Field of the Invention

The present invention generally relates to an apparatus for controlling current supply to a heater in an air-fuel ratio sensor in the exhaust passage of an internal combustion engine. More particularly, the present invention relates to a current controlling apparatus including a plurality of air-fuel sensors.

2. Description of the Related Art

An air-fuel ratio sensor is located in the exhaust passage of an external combustion engine for detecting the concentration of oxygen in the exhaust gas. The air-fuel ratio of the air-fuel mixture is computed based on the detected oxygen concentration. Typically, the computed air-fuel ratio is then compared with a predetermined target air-fuel ratio (usually a theoretical optimum air-fuel ratio). The amount of fuel in the mixture is feedback controlled such that the detected ratio becomes equal to the predetermined target ratio.

Japanese Unexamined Patent Publication No. 63-176641 discloses "an apparatus for controlling the air-fuel ratio in an internal combustion engine". This apparatus includes two $O_2$ sensors (air-fuel ratio sensor) located at the upstream and downstream sides of a three way catalytic converter. The air-fuel ratio of the engine is controlled based on the signals from the sensors. Employing two air-fuel sensors allows the actual air-fuel ratio to be accurately controlled to match a target air-fuel ratio.

Each air-fuel sensor in the above apparatus includes an element and a heater for warming the element. The element is activated when its temperature is equal to or higher than a predetermined temperature. The activated element allows the sensor to operate. The heater warms the sensor such that the temperature of the element is, for example, 350° C. to 400° C. thereby activating the element.

The recent trend of environmental protection has resulted in a stricter regulation of exhaust gas. For example, it is desired that the amount of hydrocarbon (HC) exhausted from an engine when the engine is started be minimized. Specifically, it is desired that the element in an air-fuel ratio sensor be activated at an early stage after starting of the engine. This would allow the air-fuel ratio to be adequately controlled in an early stage. One of the ways to activate the element in an early stage is to increase the heating value of the heater by lowering the value of resistance of the heater.

However, in an engine having a plurality of air-fuel ratio sensors, increasing the heat value of the heaters increases the power consumption of the heaters. FIG. 9 is a graph showing changes of current value supplied to a heater. As shown in the graph, a current having a relatively great value is supplied to the heater at the beginning of the current supply to the heater. This current is referred to as a rush current. Then, the value of the current supplied to the heater is gradually reduced until the value reaches a predetermined constant level.

If two or more heaters are parallel-connected to an electrical power source, current is simultaneously supplied to the heaters when the engine is started. In this case, current in the power source, or in the battery, is equal to or greater than the sum of the rush currents supplied to the heaters. Power consumption is thus extremely high. Therefore, starting the engine increases the load on the battery and the load on an electrical circuit for supplying the electricity of the battery (hereinafter referred to as a power source system). In particular, the increase in the power consumption drastically lowers the voltage of the battery when starting the engine or when the battery charge is relatively low.

Typical heaters are controlled by periodic ON-OFF signals as shown in FIG. 10, or duty signals, when the element is activated. In this case, currents I4 and I5 are supplied to the parallel-connected heaters, respectively.

If the two duty signals are synchronized with each other, the sum of the currents I4, I5 fluctuate periodically. Specifically, between a time T1 and a time T2, the value of each current is 2I[A] and the sum is 4I[A], while the value of each current and the sum is 0[A] between the time T2 and a time T3. In general, the chemical reaction in the battery electrolyte becomes too slow when the discharge current of the battery is great. This lowers the voltage of the battery. Fluctuations of the sum of the currents I4, I5 as described above therefore fluctuate the battery voltage. The battery voltage fluctuation causes problems in controlling the parts of the engine. For example, fluctuations of voltage applied to injectors deteriorates accuracy of fuel injection control. This results in unstable engine idling.

SUMMARY OF THE INVENTION

Accordingly, it is an objective of the present invention to provide an apparatus for controlling the heater of an air-fuel sensor, which apparatus reduces load to the power source system of the internal combustion engine.

To achieve the above objective, the present invention provides an apparatus and method for controlling the energization of a plurality of sensors used for detecting the air-fuel ratio in an internal combustion engine. The engine has an exhaust passage, and wherein the sensors are located in the exhaust passage. Each sensor includes an element for outputting a signal corresponding to the oxygen concentration of the exhaust gas from the engine and a heater for heating the element. The element is activated when it reaches a predetermined temperature. Each heater has an initially high current load that falls with time. An energizer energizes the heaters, and the energizer starts energizing each heater at a different time to reduce the total current load of the heaters.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A first embodiment of the present invention will now be described with reference to FIGS. 1 to 6.

Figure 1:
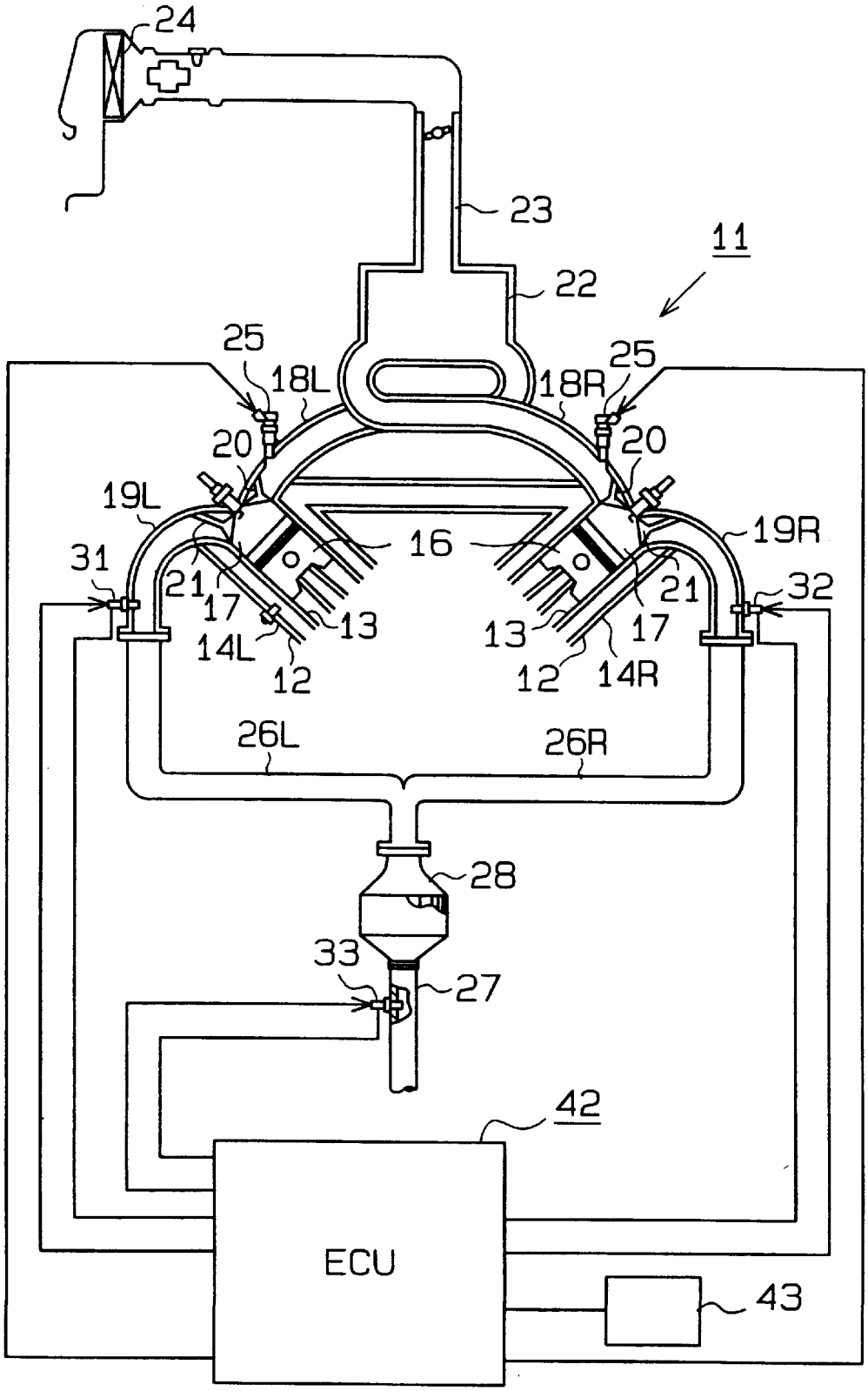
FIG. 1 is a partially cross-sectional view diagrammatically illustrating the structure of an engine system according to first and second embodiments of the present invention.

As shown in FIG. 1, a gasoline engine 11 has a cylinder block 12. The cylinder block 12 includes a plurality of cylinders 13, which are arranged in a V-shaped configuration. FIG. 1 shows one of a set of cylinders 13 of a left bank of cylinders 14L and one of set of cylinders 13 of a right bank of cylinders 14R. A piston 16 is housed in and linearly reciprocates with respect to each cylinder 13. Each piston 16 and the inner wall of the associated cylinder 13 define a combustion chamber 17 in the upper portion or the cylinder 13. Intake manifolds 18L, 18R and exhaust manifolds 19L, 19R are connected to the banks 14L, 14R, respectively. The manifolds 18L, 18R, 19L, 19R are communicated with the individual combustion chambers 17. The intake manifolds 18L, 18R ahd the exhaust manifolds 19L, 19R are provided with intake valves 20 and exhaust valves 21, respectively.

The intake manifolds 18L, 18R are connected to a surge tank 22. An intake pipe 23 is connected to the surge tank 22. An air cleaner 24 is connected to the upstream end of the intake pipe 23. The intake manifolds 18L, 18R, the surge tank 22, the intake pipe 23 and the air cleaner 24 make up an intake passage.

The outside air is drawn into the intake pipe 23 through the air cleaner 24. The air is then led to the intake manifolds 18L, 18R through the surge tank 22. The intake manifolds 18L, 18R are provided with injectors 25 that are opened by electrical current. The air in the intake manifolds 18L, 18R is mixed with fuel injected into the manifolds 18L, 18R by the injectors 25. The resultant air-fuel mixture is drawn into each combustion chamber 17 when the corresponding intake valve 20 is opened.

Combustion of the air-fuel mixture in the combustion chambers 17 generates exhaust gas, which is discharged to the exhaust manifolds 19L, 19R when the exhaust valves 21 are opened. The exhaust manifolds 19L, 19R are connected to exhaust pipes 26L, 26R, respectively. The pipes 26L, 26R are connected to an integrated exhaust pipe 27. A catalytic converter 28 containing three way catalyst is located in the exhaust pipe 27. Exhaust gas in the manifolds 19L, 19R is exhausted to the outside through the exhaust pipes 26L, 26R and 27. The catalytic converter 28 reduces hydrocarbon (HC), carbon monoxide (CO) and nitrogen oxide in the exhaust gas.

The exhaust manifold 19L is provided with a first air-fuel ratio sensor 31, while the exhaust manifold 19R is provided with a second air-fuel ratio sensor 32. The sensors 31, 32 detect the concentration of oxygen in the exhaust gas in the manifolds 19L, 19R. The integrated exhaust pipe 27 is provided with a third air-fuel ratio sensor 33, which is located at the downstream side of the converter 28. The third sensor 33 detects the concentration of oxygen in exhaust gas that has passed the converter 28. The air-fuel ratio sensors 31, 32, 33 are parallel-connected to each other.

Figure 2:
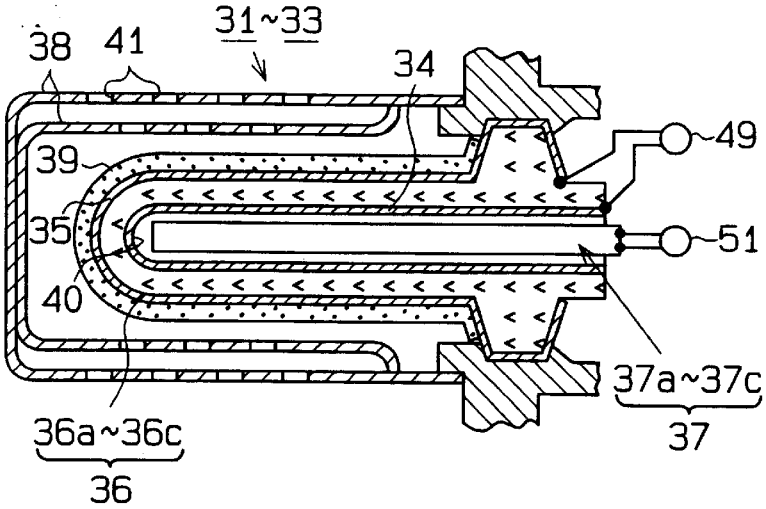
FIG. 2 is a cross-sectional view illustrating an air-fuel ratio sensor.

The first to third air-fuel ratio sensors 31 to 33 are of a limiting current type, which outputs current in accordance with the oxygen concentration in the exhaust gas. As shown in FIG. 2, which illustrates one of the sensors 31 to 33, the sensors 31 to 33 include an element 36 having two electrodes 34, 35, a heater 37 for warming the element 36, and a housing 38. The element 36 and the heater 37 of the first air-fuel ratio sensor 31 are hereinafter referred to as a first element 36*a* and a first heater 37*a*. Similarly, the element 36 and the heater 37 of the second air-fuel ratio sensor 32 are referred to as a second element 36*b* and a second heater 37*b*, and the element 36 and the heater 37 of the third air-fuel ratio sensor 33 are referred to as a third element 36*c* and a third heater 37*c*

The elements 36*a* to 36*c* are made of zirconia and formed like a test tube by sintering. A space 40 for atmospheric air, the oxygen concentration of which is known, is defined in the elements 36*a* to 36*c*.

Each of the heaters 37*a* to 37*c* includes a resistor (not shown) that produces heat when a certain voltage is applied. The heaters 37*a* to 37*c* warm the elements 36*a* to 36*c* to a certain activating temperature. The test tube shaped housings 38 have a double-wall structure and cover the elements 36*a* to 36*c* thereby securing the elements 36*a* to 36*c* to the heaters 37*a* to 37*c*. The sensors 31 to 33 are provided in the exhaust manifolds 19L, 19R and the integrated exhaust pipe 27 with the distal ends protruding from the inner wall of the manifolds 19L, 19R and the pipe 27. Each housing 38 is provided with a plurality of holes 41, through which exhaust gas flows into the housing 38.

The element 36 is provided with an inner platinum electrode 34 and an outer platinum electrode 35 formed on the inner and outer walls, respectively. A porous layer 39 is formed for covering the electrode 35 by plasma-spraying spinel material (MgO.Al).

A certain voltage is applied to the electrodes 34, 35 by an electronic control unit (ECU) 42, which will be described later. The magnitude of the current between the electrodes 34, 35 varies in accordance with the difference between the concentration of oxygen in the atmospheric air space 40 and that of exhaust gas in the housing 38, and with the magnitude of the applied voltage. The oxygen concentration in exhaust gas is detected based on the magnitude of the current between the electrodes 34, 35. The ECU 42 feedback controls the air-fuel ratio of the engine such that the computed air-fuel ratio matches a target air-fuel ratio (for example, the theoretical optimum air-fuel ratio).

The engine 11 includes a crankshaft (not shown) and a starter motor (not shown) that rotates the crankshaft for starting the engine 11. The starter motor has a starter switch 43 that detects an ON/OFF state of the starter motor and issues starter signal STA to the ECU 42. Specifically, the switch 43 issues a starter signal STA of an ON signal when the driver starts the starter motor for starting the engine 11 by moving the ignition switch from an OFF position to a start position, that is, to crank the starter. The switch 43 changes the starter signal STA from the ON signal to an OFF signal when the engine 11 starts running and the ignition switch is moved to an ON position from the start position.

Figure 3:
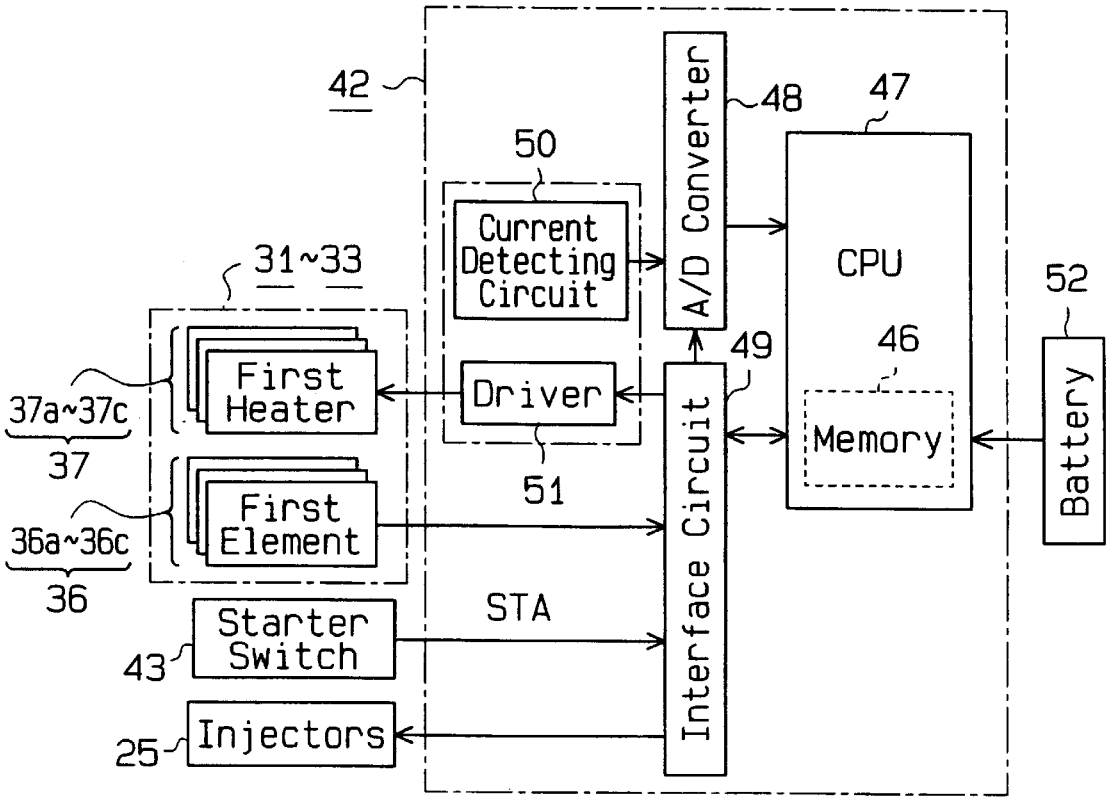
FIG. 3 is a block diagram showing the construction of an electronic control unit and other units.

As shown in FIG. 3, the ECU 42 includes a central processing unit (CPU) 47, an analog-to-digital converter 48, an interface circuit 49, a current detecting circuit 50 and a driver 51.

The current detecting circuit 50 detects current value in the heaters 37*a* to 37*c* of the air-fuel ratio sensors 31 to 33 and is connected to the analog-to-digital converter 48. The interface circuit 49 is also connected to the converter 48. The electrodes 34, 35 of the first to third elements 36*a* to 36*c*, the starter switch 43 and the injectors 25 are connected to the interface circuit 49. The first to third heaters 37*a* to 37*c* are connected to the interface circuit 49 by the driver 51.

The CPU 47 is connected to the analog-to-digital converter 48, the interface circuit 49 and a battery 52 and inputs signals from the current detecting circuit 50, the elements 36*a* to 36*c*, the starter switch 43 and other sensors (not shown). The CPU 47 controls the injectors 25 and adjusts the voltage value applied to the heaters 37*a* to 37*c* via the driver 51 based on the inputted signals.

A current controlling process in a gasoline engine system performed by the CPU 47 will be explained with reference to flowcharts of FIGS. 4 and 5. In this process, the CPU 47 controls the current supply to the heaters 37*a* to 37*c*.

Figure 4:
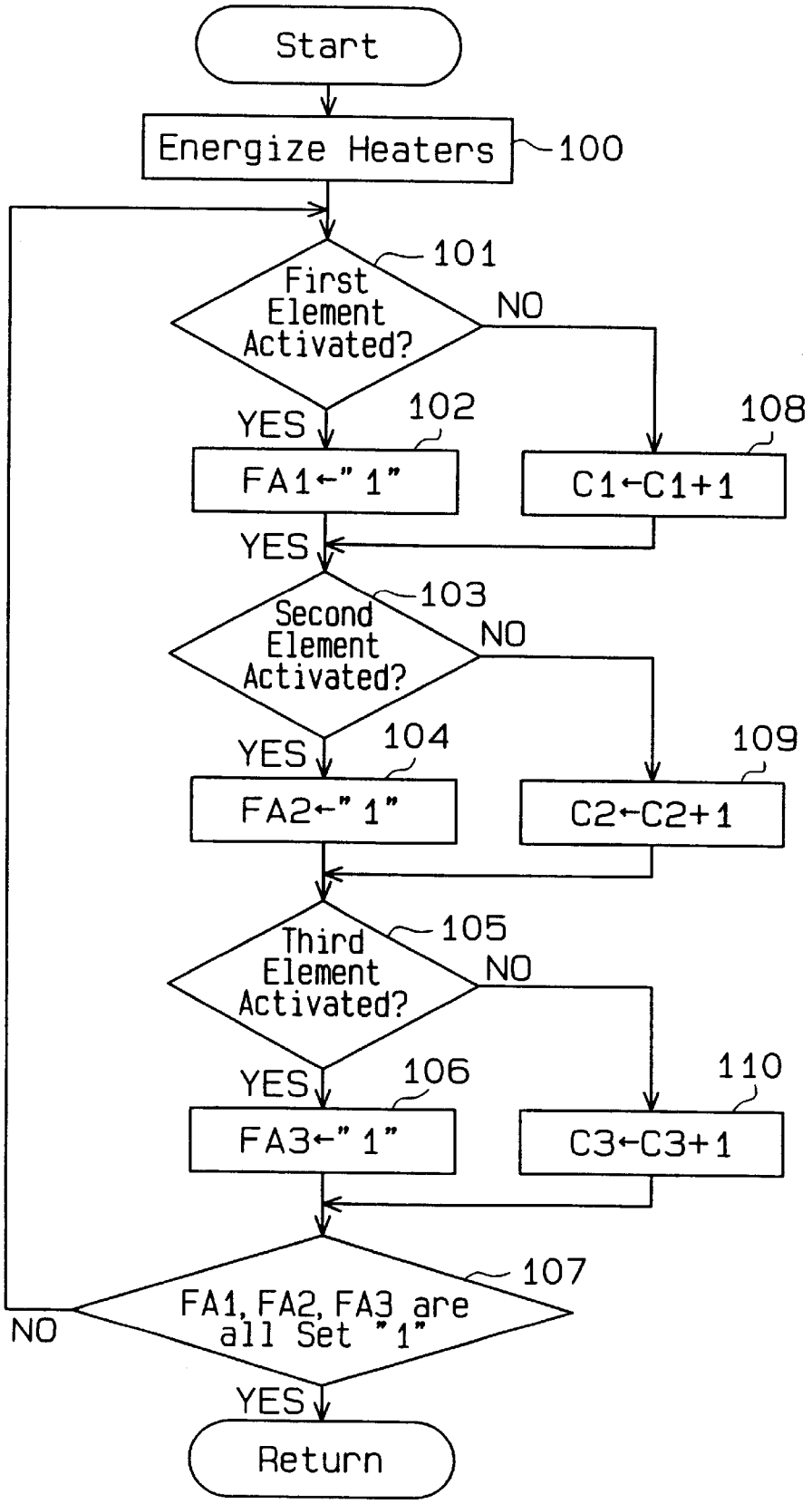
FIG. 4 is a flowchart showing a routine for measuring time period required for activating air-fuel ratio sensors.
Figure 5:
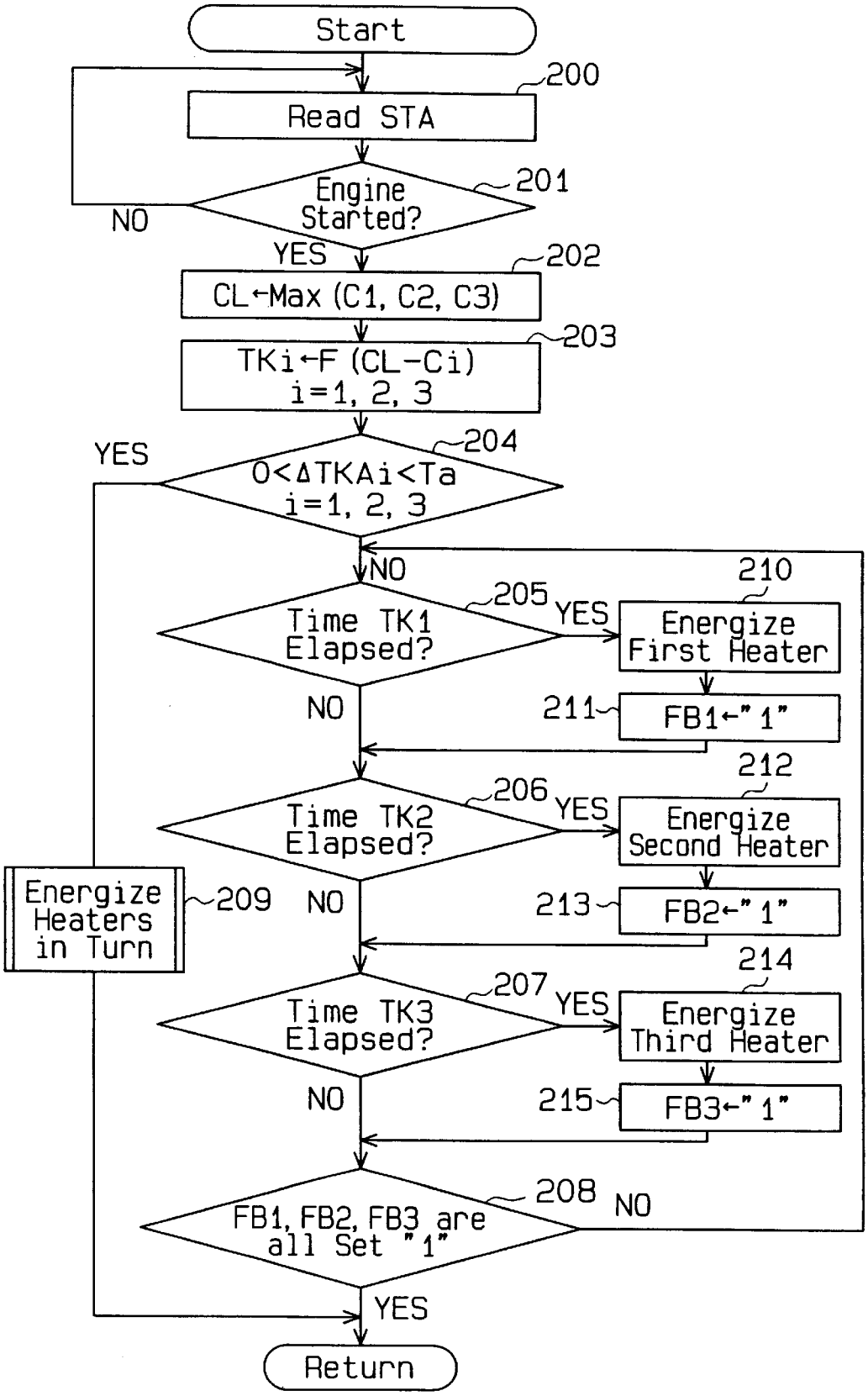
FIG. 5 is a flowchart showing a routine for controlling the time at which heaters start being energized.

FIG. 4 shows a flowchart of a routine for measuring a time period required for increasing the temperature of the elements 36*a* to 36*c* to a temperature that activates the elements 36*a* to 36*c*. The time period will hereinafter be referred to as "activating time". The CPU 47 performs this routine only once when the engine 11 is started for the very first time.

In step 100, the CPU 47 simultaneously starts energizing the first to third heaters 37*a* to 37*c*. This causes the heaters 37*a* to 37*c* to produce heat thereby warming the first to third elements 36*a* to 36*c*, respectively.

In step 101, the CPU 47 judges whether the first element 36*a* is activated based on the value of resistance of the first heater 37*a*. Specifically, the CPU 47 judges whether the resistance value of the heater 37*a* has been increased to a predetermined level. The CPU 47 detects the voltage value applied to the heater 37*a* and detects the current value in the heater 37*a* based on the signal from the current detecting circuit 50. The CPU 47 computes the resistance value of the first heater 37*a* based on the detected voltage and current values. Since the resistance value of the heater 37*a* increases as its temperature increases, the CPU 47 can compute the temperature of the first heater 37*a* based on the computed resistance value. The CPU 47 determines that the first element 36*a* is activated when the computed temperature of the heater 37*a* is as high as the activating temperature of the first element 36*a* (for example, 700° C.). If the temperature of the heater 37*a* is lower than the activating temperature of the first element 36*a*, the CPU 47 determines that the first element 36*a* has not yet been activated.

If the determination condition is not satisfied in step 101, the CPU 47 moves to step 108. In step 108, the CPU 47 adds "1" to a first counter value C1 and moves to step 103. The first counter value C1 represents the elapsed time since the first heater 37*a* was energized. Thus, the final first counter value C1 represents the activation time of the element 36*a*.

If the determination condition is satisfied in step 101, the CPU 47 moves to step 102. In step 102, the CPU 47 sets a first activation flag FA1 to "1" and moves to step 103. The flag FA1 indicates that the first element 36*a* is activated. Second and third activation flags FA2 and FA3, which will be explained below, similarly indicate that the second and third elements 36*b*, 36*c* are activated.

In step 103, the CPU 47 judges whether the second element 36*b* is activated by performing the same process as in step 101.

If the determination condition is not satisfied in step 103, the CPU 47 moves to step 109. In step 109, the CPU 47 adds "1" to a second counter value C2 and moves to step 105. The final value of the second counter value C2 represents the activation time of the second element 36*b*.

If the determination is satisfied in step 103, the CPU 47 moves to step 104. In step 104, the CPU 47 sets the second activation flag FA2 to "1" and moves to step 105.

In step 105, the CPU 47 judges whether the third element 36*c* is activated by performing the same process as in steps 101 and 103.

If the determination is not satisfied in step 105, the CPU 47 moves to step 110. In step 110, the CPU 47 adds "1" to a third counter value C3 and moves to step 107. The final value of the third counter value C3 represents the activation time of the third element 36*c*.

If the determination is satisfied in step 105, the CPU 47 moves step 106. In step 106, the CPU 47 sets a third activation flag FA3 to "1" and moves to step 107.

In step 107, the CPU 47 judges whether all of the flags FA1 to FA3 are set to "1". If this determination is not satisfied, that is, if any one of the first to third elements 36*a* to 36*c* is not activated, the CPU 47 moves back to step 101 for repeating the routine.

If the determination is satisfied in step 107, that is, if all of the first to third elements 36*a* to 36*c* are activated, the CPU 47 terminates this routine.

Performing the processes of the above routine, the CPU 47 measures the time period required for activating the elements 36*a* to 36*c* from when the heaters 37*a* to 37*c* are energized. The final first to third counter values C1 to C3, which represent the time periods required for activating the elements 36*a* to 36*c*, respectively, are stored in the memory 46.

A routine for controlling times to start energizing the air-fuel ratio sensors 31 to 33 will hereafter be explained with reference to the flowchart of FIG. 5. This routine is performed by the CPU 47 when the ignition switch is moved from the OFF position to the ON position.

In step 200, the CPU 47 inputs the starter signal STA from the starter switch 43. In step 201, the CPU 47 judges whether starting of the engine 11 has been completed. Specifically, the CPU 47 determines that the starting of the engine 11 is completed when the starter signal STA has changed from ON to OFF. If the determination is not satisfied in step 201, that is, if the engine 11 is still being cranked, the CPU 47 repeats the processes of steps 200, 201. If the determination is satisfied in step 201, the CPU 47 moves to step 202.

In step 202, the CPU 47 adopts the largest value among the final counter values C1 to C3 stored in the memory 46 as a maximum counter value CL. In step 203, the CPU 47 computes the difference between the maximum counter value CL and each of the counter values C1 to C3 and converts the differences into time (seconds). The CPU 47 stores the computed time as determination time periods TK1 to TK3.

For example, if the activation time of the third element 36*c* is longer than that of the first and second elements 36*a*, 36*b*, the third counter value C3 is adopted as the maximum counter value CL. The determination time period TK1 is computed by subtracting the activating time of the first element 36*a* from that of the third element 36*c* and the determination time period TK2 is computed by subtracting the activating time of the second element 36*b* from that of the third element 36*c*. The determination time period TK3 is set to zero.

Figure 9:
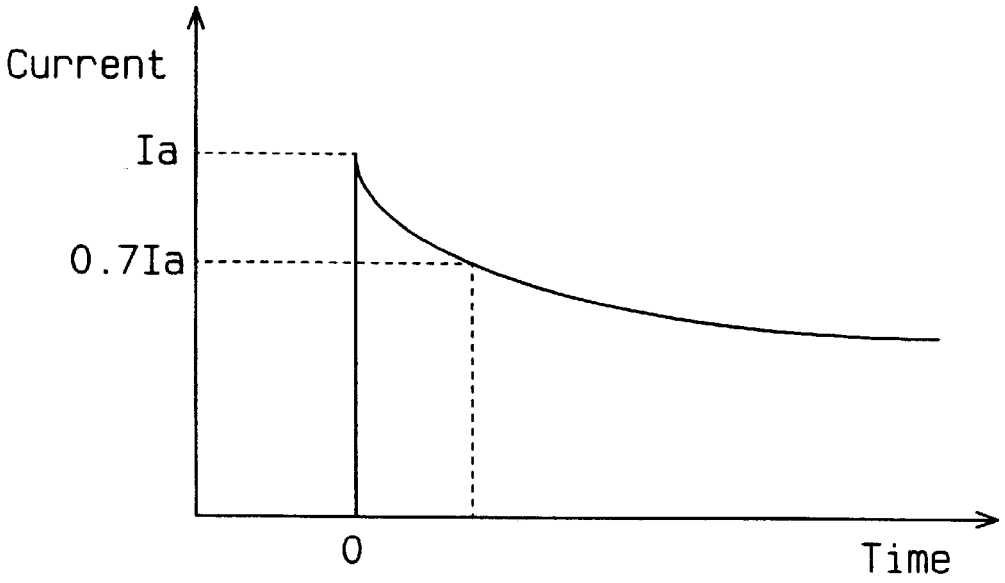
Fig.9(Prior Art)
FIG. 9 is a timing chart showing changes of current values supplied to a prior art air-fuel ratio sensor.
Figure 10:
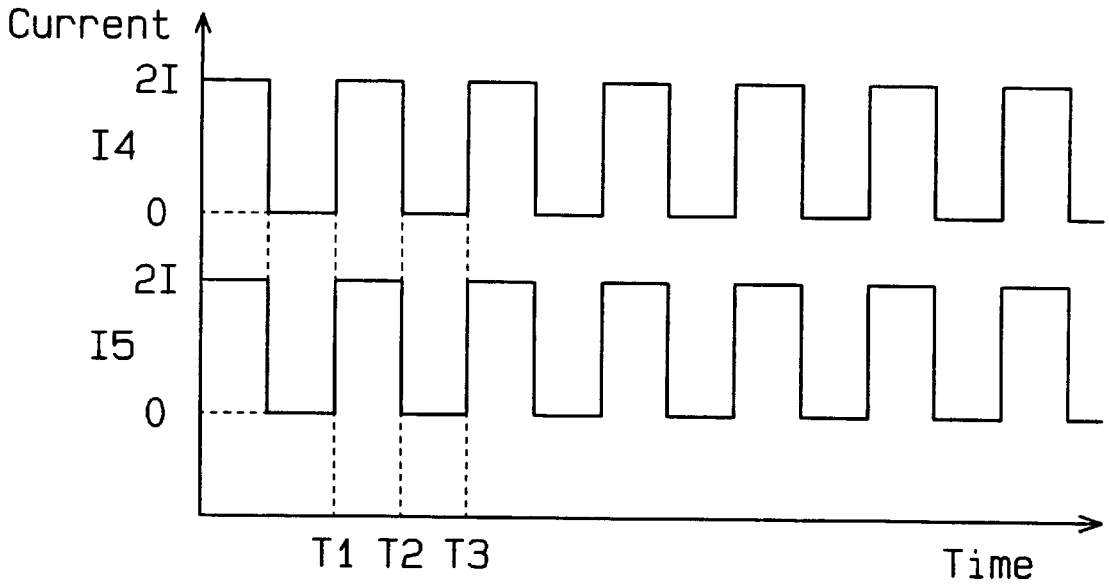
Fig.10(Prior Art)
FIG. 10 is a timing chart showing changes of current values supplied to a prior art air-fuel ratio sensor.

In step 204, the CPU 47 computes the absolute values of the differences among the determination time periods TK1 to TK3 as ΔTKA1, ΔTKA2, ΔTKA3. The absolute value ΔTKA1 represents the difference between the determination time periods TK1 and TK2 (|TK1−TK2|). The absolute value ΔTKA2 represents the difference between the determination time periods TK1 and TK3 (|TK1−TK3|). The absolute value ΔTKA3 is the absolute value of the difference between the determination times TK2 and TK3 (|TK2−TK3|). The CPU 47 judges whether the absolute values ΔTKA1, ΔTKA2, ΔTKA3 are greater than zero and smaller than a predetermined time period Ta. In this embodiment, the predetermined time period Ta is two seconds. As described above, when the heaters 37*a* to 37*c* are initially energized, a rush current having relatively high value is supplied to the heaters 37*a* to 37*c*. The current value decreases until it becomes constant (see FIG. 9). In this embodiment, the predetermined time period Ta is the time period from the start of energizing to the time at which the rush current has decreased to 70% of the initial value. Specifically, if the rush current is Ia as shown in FIG. 9, the predetermined time period Ta is time period during which the current to the heaters 37*a* to 37*c* decreases to 0.7Ia.

If the determination is satisfied in step 204, that is if at least one of the absolute values ΔTKA1 to ΔTKA3 is greater than zero and smaller than the predetermined time period Ta, the CPU 47 moves to step 209. In step 209, the CPU 47 successively starts energizing the first to third heaters 37*a* to 37*c* at intervals of the predetermined time period Ta (two seconds), and then terminates this routine.

If the determination is not satisfied in step 204, the CPU 47 moves to step 205. If the determination is satisfied in step 204 on the other hand, the CPU 47 moves to step 209.

In step 205, the CPU 47 judges whether the determination time period TK1 has elapsed since starting of the engine 11. If the determination is satisfied, the CPU 47 moves to step 210, and if not, the CPU 47 moves to step 206. In step 210, the CPU 47 starts energizing the first heater 37*a*. In step 211, CPU 47 sets a first energizing flag FB1 to "1" and moves to step 206. The first energizing flag FB1 indicates that energizing of the first heater 37*a* has started. Second and third energizing flags FB2, FB3, which will be described below, also indicate that energizing of the second and third heaters 37*b*, 37*c* has started.

In step 206, which follows steps 205, 211, the CPU 47, as in step 205, judges whether the determination time period TK2 has elapsed since starting of the engine 11. If the determination is satisfied, the CPU 47 moves to step 212, if not the CPU 47 moves to step 207. In step 212, the CPU 47 starts energizing the second heater 37*b*. In step 213, the CPU 47 sets the energizing flag FB2 to "1" and moves to step 207.

In step 207, which follows steps 206, 213, the CPU 47, as in steps 205, 206, judges whether the determination time period TK3 has elapsed since starting of the engine 11. If the determination is satisfied, the CPU 47 moves to step 214. If not, the CPU 47 moves to step 208. In step 214, the CPU 47 starts energizing the third heater 37*c*. In step 215, the CPU 47 sets the third energizing flag FB3 to "1".

In step 208, which follows steps 207, 215, the CPU 47 judges whether all the flags FB1 to FB3 have been set to "1". If the determination is not satisfied, that is, if the CPU 47 has not started energizing any one of the heaters 37*a* to 37*c*, the CPU 47 moves back to step 205 and repeats the process of step 205 and the subsequent steps. If the determination is satisfied in step 208, that is, if the CPU 47 has started energizing all the heaters 37*a* to 37*c*, the CPU 47 terminates this routine.

The operation and advantages of the above preferred embodiment will now be described with reference to the timing chart of FIG. 6.

Suppose that the activating time of the third. element 36*c* is the longest and the activating time of the first element 36*a* is the shortest (C1<C2<C3) in the above described activating time measuring routine.

When the starting of the engine 11 is completed and the determination of step 201 is satisfied, CPU 47 moves to step 202. In step 202, the CPU 47 adopts the third counter value C3 as the maximum counter value CL and moves to step 203. In step 203, the CPU 47 computes the determination time periods TK1 to TK3 based on the maximum counter value CL and the counter values C1 to C3. In the description below, the absolute values ΔTKA1 to ΔTKA3 are made equal to or greater than the predetermined time period Ta.

Figure 6:
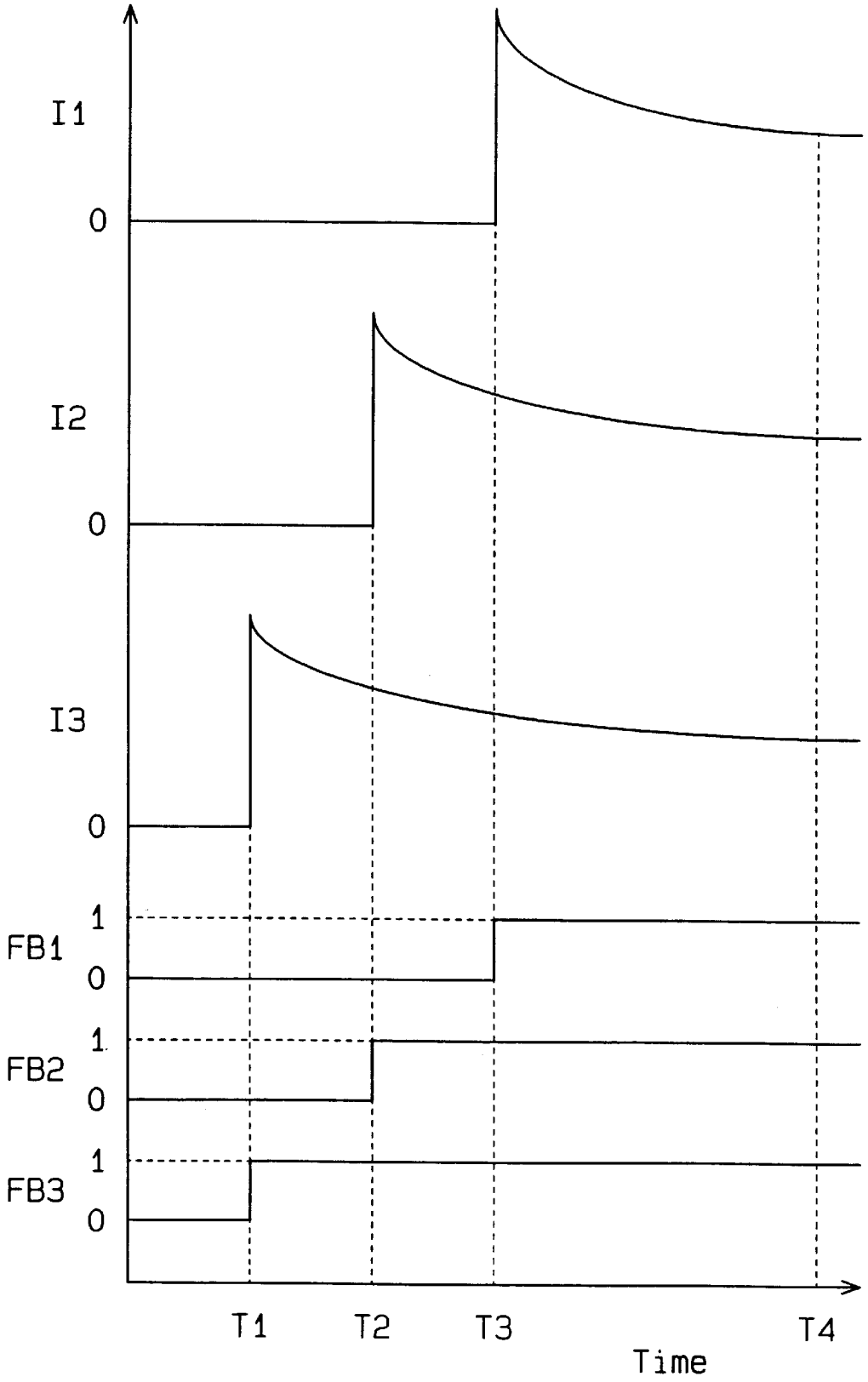
FIG. 6 is a timing chart showing changes of current values supplied to heaters.

If the starting of the engine 11 is completed at the time T1 in FIG. 6, the determination of step 207 is satisfied. Therefore, the CPU 47 starts energizing the third heater 37*c* and sets the third energizing flag FB3 to "1". In the period between the time T1 and the time T2, the determination time period TK1, TK2 have not elapsed since the completion of engine starting. The CPU 47 thus does not energize the first and second heaters 37*a* and 37*b* and does not set the flags FB1, FB2 to "1". Since the determination in step 208 is not satisfied, the CPU 47 repeats the processes of steps 205 to 208. In this manner, the CPU 47 only energizes the third heater 37*c* between the times T1 and T2.

At the time T1, the greatest current, or rush current, is supplied to the third heater 37*c*. Then, the current value I3 gradually decreases. The reason for the decrease in the current value I3 is that the current supply causes the heater 37*c* (resistor) to generate heat thereby increasing the value of resistance of the heater 37*c*. The values of currents supplied to the first and second heaters 37*a*, 37*b* change in the same manner as the current to the third heater 37*c*.

When the elapsed time from the starting of the engine is equal to the determination time period TK2 (at the time T2), the determination in step 206 is satisfied. The CPU 47 thus starts energizing the second heater 37*b* and sets the second energizing flag FB2 to "1". Upon the start of energization of the second heater 37*b*, a rush current is supplied to the second heater 37*b*.

Since a certain length of time has passed at the time T2 since energizing of the third heater 37*c* was started, the current value in the third heater 37*c* has drastically decreased from the rush current. Therefore, the sum of the current values I2, I3 in the second and third heaters 37*b*, 37*c* is not excessive.

In the period between the time T2 and the time T3, the determination time period TK1 has not elapsed since the completion of engine starting. The CPU 47 thus does not energize the first heater 37*a*. In other words, the CPU 47 is energizing only the second and third heaters 37*b*, 37*c*.

When the time period that has elapsed since the completion of engine starting is equal to the determination time period TK1 (at the time T3), the determination in step 205 is satisfied. The CPU 47 therefore starts energizing the first heater 37*a* and sets the first energizing flag FB1 to "1". In this manner, the CPU 47 starts energizing the first heater 37*a* and, at the same time, a rush current is supplied to the heater 37*a*.

Since a certain length of time has passed at the time T3 since the CPU 47 started energizing the second and third heaters 37*b*, 37*c*, the current value in the third heater 37*c* has drastically decreased from the rush current. At the time T3, a rush current is supplied to the first heater 37*a*. However, the current values I2, I3 to the second and third heaters 37*b*, 37*c* have decreased at the time T3. Therefore, the sum of the current values I1 to I3 in the second and third heaters 37*a* to 37*c* is not excessive.

As described above, the CPU 47 starts energizing the heater 37*a* and sets the first energizing flag FB1 to "1" at the time T3. At this time all of the flags FB1 to FB3 are "1". This satisfies the determination of step 208. The CPU 47 thus terminates this routine.

From the time T3 onward, the first to third heaters 37*a* to 37*c* are energized. Although it depends on the running condition of the engine 11, the first to third elements 36*a* to 36*c* are almost simultaneously activated at a time T4.

As described above, the start time of energizing is different for each of the heaters 37*a* to 37*c*. This prevents the sum of current values to the heaters 37*a* to 37*c* from being excessive. In other words, the heaters 37*a* to 37*c* are energized in a manner such that the time for sending the rush current is different for each of the heaters 37*a* to 37*c*. This reduces the sum of the current values I1 to I3 of the heaters 37*a* to 37*c*. Excessive load to the battery 52 is thus avoided.

Since the sum of the current values I1 to I3 is decreased, the diameter of the wires connecting the heaters 37*a* to 37*c* with the ECU 42 can be smaller. The decrease in the sum of the current values also lowers the electrical power consumption thereby allowing the size of the generator and the capacity of the battery to be smaller. The cost of the engine system is thus reduced.

Although the start of energizing is different for each of the elements 36*a* to 36*c*, the elements 36*a* to 36*c*. reach the activating temperature substantially at the same time. The time period required for activating all the elements 36*a* to 36*c* is not delayed compared to the prior art. As a result, the start of the feedback control by the air-fuel ratio sensors 31 to 33 is not delayed. Therefore, the amount of hydrocarbon (HC) that is exhausted when the engine 11 is started is reduced.

If any one of the absolute values ΔTKA1 to ΔTKA3 is smaller than the predetermined time period Ta, the CPU 47 successively starts energizing the first to third heaters 37*a* to 37*c* in step 209 at intervals of the predetermined time period Ta. In other words, at least the time period Ta is secured between each starting time of energizing. During each time period Ta, the current values I1 to I3 are lowered from the rush current. Accordingly, the sum of the currents I1 to I3 of the heaters 37*a* to 37*c* is prevented from being excessive.

Figure 7:
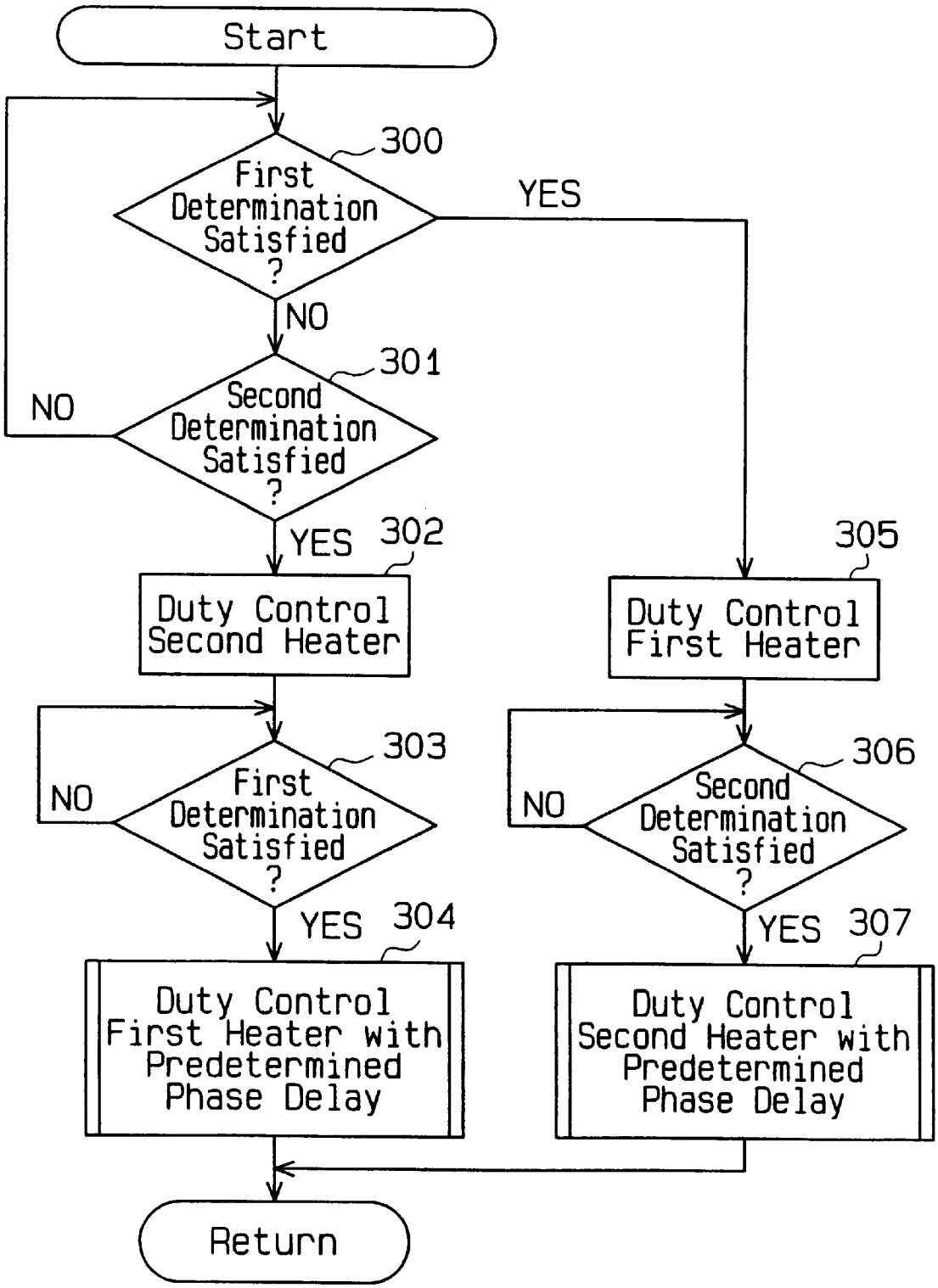
FIG. 7 is a flowchart showing a routine for controlling duty signals supplied to heaters according to the second embodiment.

A second embodiment will now be described with reference to FIGS. 7 and 8. To avoid a redundant description, like or same reference numerals are given to those components that are like or the same as the corresponding components of the first embodiment.

In this embodiment, the third air-fuel ratio sensor 33, which is provided in the integrated exhaust pipe 27 in the first embodiment, is omitted. In the gasoline engine system of this embodiment, the air-fuel ratio of the engine 11 is feedback controlled only by the first and second air-fuel ratio sensors 31, 32.

Continuous current is supplied to the heaters 37*a*, 37*b* until the elements 36*a*, 36*b* are activated. After the elements 36*a*, 36*b* are activated, duty signals including ON and OFF signals are supplied to the elements 36*a*, 36*b*. Changing the continuous current to the duty signals prevents the heaters 37*a*, 37*b* from being overheated.

A routine for controlling current with duty signals will hereafter be described with reference to the flowchart of FIG. 7. This routine is performed by the CPU 47. The CPU 47 starts performing this routine when the ignition switch is moved from the OFF position to the ON position.

In step 300, the CPU 47 judges whether a first determination is satisfied. The first determination is designed for detecting whether the temperature of the first element 36*a* has reached the activating temperature. The first determination is satisfied when one of the following conditions, (a) or (b), is met:

(a) When the resistance value of the heater 37*a* reaches a predetermined level.

In this case, the temperature of the first element 36*a* is judged to have reached the activating temperature when the resistance value of the heater 37*a* reaches the predetermined level.

(b) When the consumed electric energy since the start of energizing the first heater 37*a* surpasses a predetermined level.

In this case, the temperature of the first element 36*a* is judged to have reached the activating temperature when electric energy consumed by the first heater 37*a* surpasses the predetermined level.

If the first determination is satisfied, the CPU 47 moves to step 305. If not, the CPU 47 moves to step 301.

In step 305, the CPU 47 changes the current to the first heater 37*e* from the continuous current to a duty signal and moves to step 306. The timing chart of FIG. 8 shows changes in the current value supplied to the heaters 37*a*, 37*b* when the heaters 37*a*, 37*b* are duty controlled. The changes of the current values I1, I2 correspond to changes in voltage applied to the heaters 37*a*, 37*b*, or changes of duty signals.

Figure 8:
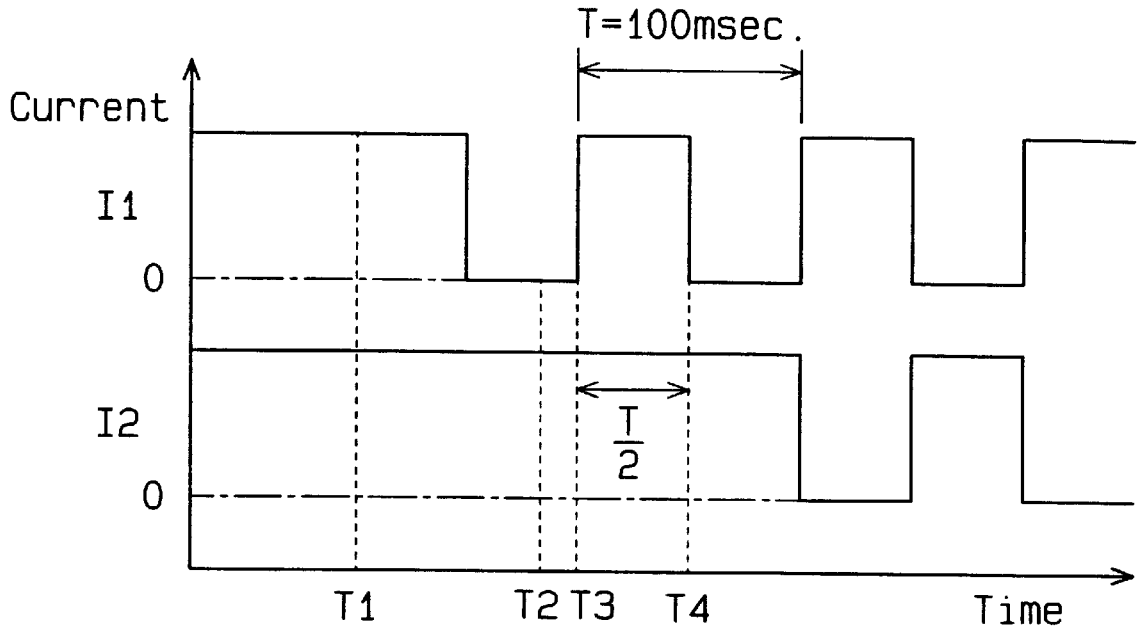
FIG. 8 is a timing chart showing changes of current values supplied to heaters.

As described in FIG. 8, the duty signals inputted to the heaters 37*a*, 37*b* have a cycle T of 100 msec. The duty signals include ON signals, which are 50 msec and high level, and OFF signals, which are 50 msec and low level. The duty ratio of the duty signals is 50%.

In step 306, the CPU 47 judges whether a second determination is satisfied. The second determination is designed for detecting whether the temperature of the second element 36*b* has reached the activating temperature. Similar to the first determination, the second determination is satisfied when one of the following conditions, (a) or (b), is met:

(a) When the resistance value of the heater 37*b* reaches a predetermined level; or (b) When electric energy consumed by the second heater 37*b* since the start of current supply to the second heater 37*b* surpasses a predetermined level.

If either one of the conditions (a) or (b) is met, that is, if the second determination is satisfied, the CPU 47 determines that the temperature of the second element 36*b* has reached the activating temperature and moves to step 307. The CPU 47 repeats the process of step 306 until the second determination is satisfied.

In step 307, the CPU. 47 changes the current to the second heater 37*b* from the continuous current to a duty signal. At this time, the CPU 47 transmits a duty signal having a phase delay of half cycle (T/2) with respect to the duty signal transmitted to the first heater 37*a*. In other words, the CPU 47 starts transmitting the duty signal to the second heater 37*b* when 50 msec have passed since the duty signal to the first heater 37*a* was changed from an OFF signal to an ON signal.

The duty signals to the heaters 37*a*, 37*b* therefore have opposite phases. When current is supplied to the first heater 37*a*, current is not supplied to the second heater 37*b*. Contrarily, the second heater 37*b* is supplied with current when the first heater 37*a* is not supplied with current. After performing the process of step 307, the CPU 47 terminates this routine.

In step 301, which follows step 300, the CPU 47 judges whether the second determination is satisfied by performing the same process as step 306. If the second determination is not satisfied, the CPU 47 repeats the process of step 300 and the subsequent steps. If the second determination is satisfied, the CPU 47 determines that the temperature of the second element 36*b* has reached the activating temperature and moves to step 302.

In step 302, the CPU 47 changes the current to the second heater 37*b* from the continuous current to a duty signal and moves to step 303. In step 303, the CPU 47 judges whether the first determination is satisfied by performing the same process as in step 300. If the first determination is satisfied, the CPU 47 moves to step 304. The CPU 47 repeats the process of step 303 until the first determination is satisfied.

In step 304, the CPU 47 changes the current to the first heater 37*a* from the continuous current to a duty signal. At this time, as in step 307, the CPU 47 transmits a duty signal having a phase delay of half cycle (T/2) with respect to the duty signal transmitted to the second heater 37*b*. As a result, the duty signals to the heaters 37*a*, 37*b* have opposite phases. After performing the process of step 304, the CPU 47 terminates this routine.

In the above described routine, the heaters 37*a*, 37*b* are provided with duty signals of opposite phases. A description will be given with reference to FIG. 8 for explaining changes of current values I1, I2 when the first element 36*a* reaches the activating temperature before the second element 36*b*.

As shown in FIG. 8, when the first determination is satisfied at the time T1 in step 300, the CPU 47 moves from step 300 to step 305. In step 305, the CPU 47 starts sending duty signal to the first heater 37*a*. During the period between the times T1 and T2, only the first heater 37*a* is duty controlled.

If the second determination is satisfied at the time T2 in step 306, the CPU 47 moves to step 307. In step 307, the CPU 47 changes the current to the second heater 37*b* from the continuous current to a duty signal at the time T4. The time T3 is the time at which the duty signal to the first heater 37*a* is changed form an OFF signal to an ON signal, and the time T4 is the time when 50 msec has passed from the time T3. As a result, as shown in FIG. 8, the duty signal to the second heater 37*b* is a duty signal of opposite phase with respect to the first heater 37*a*.

As described above, current is alternately supplied to the heaters 37*a*, 37*b*. In other words, the currents are not supplied to the heaters 37*a*, 37*b* simultaneously. Therefore, the sum of the current value to the heaters 37*a*, 37*b* at a given moment is the half that of the prior art. This reduces the electric power consumed by the heaters 37*a*, 37*b* and the load to the battery 52. Further, once the duty control of the heaters 37*a*, 37*b* is started, the sum of the current value to the heaters 37*a*, 37*b* becomes constant. This suppresses changes in the battery voltage. Accordingly, operation of various actuators driven by the battery voltage is stabilized. For example, voltage supplied to the injectors is stabilized. This improves the accuracy of fuel injection control thereby stabilizing the engine idling.

The sum of the current values to the heaters 37*a*, 37*b* is reduced to half that of the prior art during the duty control. Therefore, the current value I1, I2 in the heaters 37*a*, 37*b* may be increased by lowering the resistance values of the heaters 37*a*, 37*b*. This increases the heat value of the heaters 37*a*, 37*b*. Accordingly, the elements 36*a*, 36*b* are activated more quickly.

Although only two embodiments of the present invention have been described herein, it should be apparent to those skilled in the art that the present invention may be embodied in many other specific forms without departing from the spirit or scope of the invention. Particularly, it should be understood that the invention may be embodied in the following forms.

(1) Instead of being a limiting current type, the air-fuel ratio sensors 31 to 33 may be of an oxygen concentration cell type, which generates electromotive force in accordance with the concentration of oxygen in exhaust gas. Further, limiting current type sensors and oxygen concentration cell type sensors may be employed together.

(2) In the first embodiment, regardless of the differences in the activating time of the elements 36*a* to 36*c*, the order of the start of energizing the heaters 37*a* to 37*c* may be changed if rush currents are not supplied to the heaters 37*a* to 37*c* at the same time.

(3) The control of starting of energizing according to the first embodiment and the duty control according to the second embodiment may be employed together. Specifically, the heaters 37*a* to 37*c* are energized at different times. Then, continuous current to the heaters 37*a* to 37*c* is changed to duty signal in the order in which the temperature of each heater reaches the activating temperature. This construction further lowers the load on the battery 52.

(4) In the second embodiment, three or more air-fuel ratio sensors may be employed. If three sensors are employed, duty signals having a phase delay of one third cycle are inputted to each sensor. In this case, a duty ratio of 33% or less prevents the sensors from being energized simultaneously. Therefore, as in the second embodiment, the load on the battery is reduced.

(5) In the second embodiment, the duty ratio of signals to heaters 37*a*, 37*b* may be changed in accordance with the conditions of the heaters 37*a*, 37*b* and with the running condition of the engine 11.

Therefore, the present examples and embodiments are to be considered as illustrative and not restrictive and the invention is not to be limited to the details given herein, but may be modified within the scope and equivalence of the appended claims.

What is claimed is:

1. An apparatus for controlling the energization of a plurality of sensors used for detecting the air-fuel ratio in an internal combustion engine, wherein the engine has an exhaust passage, and wherein the sensors are located in the exhaust passage, each sensor including an element for outputting a signal corresponding to the oxygen concentration of the exhaust gas from the engine and a heater for heating the element, wherein the element is activated when it reaches a predetermined temperature, and wherein each heater has an initially high current load that falls with time, the apparatus comprising:

an energizer for energizing the heaters; and a timer for measuring a time period for each element to reach the predetermined temperature, wherein the energizer performs subsequent energizations based on the measured time period.

2. An apparatus for controlling the energization of a plurality of sensors used for detecting the air-fuel ratio in an internal combustion engine, wherein the engine has an exhaust passage, and wherein the sensors are located in the exhaust passage, each sensor including an element for outputting a signal corresponding to the oxygen concentration of the exhaust gas from the engine and a heater for heating the element, wherein the element is activated when it reaches a predetermined temperature, and wherein each heater has an initially high current load that falls with time, the apparatus comprising:

an energizer for energizing the heaters, wherein the energizer starts energizing each heater at a different time to reduce the total current load of the heaters, wherein each element has a predetermined heating time period during which it is heated to the predetermined temperature, and wherein the energizer determines the order of the heating time periods from the longest to the shortest, and wherein the energizer first energizes the heater associated with the element that has the longest heating time period and subsequently energizes the other heaters in the order of descending heating time periods.

3. The apparatus according to claim 2, further comprising a timer for measuring the time period that each element takes to reach the predetermined temperature, wherein the predetermined heating time periods are the measured time periods.

4. The apparatus according to claim 2, wherein the energizer waits for a predetermined minimum time interval to elapse from the time when the energizer starts energizing one heater to the time when the energizer starts energizing the next heater.

5. The apparatus according to claim 2, wherein once the elements are activated, the energizer applies a duty signal to each heater that includes an on-signal and an off-signal, wherein the duty signal inputted to each heater has a different phase from that inputted to the other heaters to reduce the total current load of the heater.

6. The apparatus according to claim 5, wherein the energizer inputs an on-signal to one heater while the energizer inputs an off-signal to another of the heaters.

7. The apparatus according to claim 1, wherein each element has a predetermined heating time period that is the measured time period, and wherein for subsequent energizations, the energizer determines the order of the predetermined heating time periods from the longest to the shortest, and wherein for subsequent energizations, the energizer first energizes the heater associated with the element that has the longest predetermined heating time period and subsequently energizes the other heaters in the order of descending predetermined heating time periods.

8. The apparatus according to claim 6, further comprising a determiner for determining whether each element is activated, wherein said energizer initially applies a direct current voltage to each element, and said energizer starts applying the duty signal to each element when each element is activated.

9. The apparatus according to claim 8, wherein the determiner determines whether the electrical resistance of each heater has increased to a predetermined value to determine whether the associated element is activated.

10. The apparatus according to claim 8, wherein the determiner determines whether power consumed by each heater has increased to a predetermined value to determine whether the associated element is activated.

11. The apparatus according to claim 6, wherein the number of sensors provided for the engine is two, and wherein the duty ratio of the signal inputted to the two sensors is 50 percent, and wherein the two duty signals have opposite phases.

12. A method for controlling the energization of a plurality of sensors used for detecting the air-fuel ratio in an internal combustion engine, wherein the engine has an exhaust passage, and wherein the sensors are located in the exhaust passage, each sensor including an element for outputting a signal corresponding to the oxygen concentration of the exhaust gas from the engine and a heater for heating the element, wherein the element is activated when it reaches a predetermined temperature after the associated heater is energized by an energizer, and wherein each heater has an initially high current load that falls with time, the method comprising:

measuring the time period that each element takes to reach the predetermined temperature; and initializing subsequent energizations of each heater at a different time, based on the measured time period to reduce the total current load of the heaters.

13. A method for controlling the energization of a plurality of sensors used for detecting the air-fuel ratio in an internal combustion engine, wherein the engine has an exhaust passage, and wherein the sensors are located in the exhaust passage, each sensor including an element for outputting a signal corresponding to the oxygen concentration of the exhaust gas from the engine and a heater for heating the element, wherein the element is activated when it reaches a predetermined temperature after the associated heater is energized by an energizer, wherein each element has a predetermined heating time period during which it is heated to the predetermined temperature, and wherein each heater has an initially high current load that falls with time, the method comprising:

initializing energization of each heater at a different time to reduce the total current load of the heaters;

determining the order of the heating time periods from the longest to the shortest;

first energizing the heater associated with the element that has the longest time period; and subsequently energizing the other heaters in the order of descending heating time periods.

14. The method according to claim 13, wherein after the elements are activated, the method further comprises the steps of:

applying direct current voltage to the heaters to heat the elements, and inputting each heater a duty signal that includes an on-signal and an off-signal, wherein the duty signal inputted to each heater has a different phase from that inputted to the other heaters.

15. The method according to claim 14, wherein an on-signal is inputted to one heater while an off-signal is inputted to another of the heaters.

16. The method according to claim 13, further comprising:

determining whether each element is activated;

initially applying a direct current voltage to each element; and applying the duty signal to each element when each element is activated.

17. The method according to claim 16, further comprising determining whether the electrical resistance of each heater has increased to a predetermined value to determine whether the associated element is activated.

18. The method according to claim 16, further comprising determining whether the power consumed by each heater has increased to a predetermined value to determine whether the associated element is activated.

* * * * *